United States Patent [19]

Taylor et al.

[11] 4,153,161

[45] May 8, 1979

[54] SLIP SHEET RETAINING CLIP

[76] Inventors: Charles F. Taylor; Richard J. Taylor, both of 150 E. Industry, La Habra, Calif. 90631

[21] Appl. No.: 875,680

[22] Filed: Feb. 6, 1978

[51] Int. Cl.[2] ..... B65G 1/14

[52] U.S. Cl. ..... 206/386; 24/81 BF; 24/85 R; 206/600

[58] Field of Search ..... 214/10.5 R; 105/463, 105/465, 471, 472, 488; 206/386, 600; 24/81 BF, 73 R, 73 PC; 53/128, 138 R, 410

[56] References Cited

U.S. PATENT DOCUMENTS

| | | | |
|---|---|---|---|
| 2,822,096 | 2/1958 | Buratovich | 14/10.5 R |
| 3,043,450 | 7/1962 | Caprin et al. | 214/10.5 R |
| 3,347,185 | 10/1967 | Colas | 206/600 X |
| 3,369,676 | 2/1968 | Swetnam | 214/10.5 R |
| 3,493,107 | 2/1970 | Markey | 14/10.5 R X |
| 3,964,618 | 6/1976 | Dreyer | 214/10.5 R |
| 4,068,353 | 1/1978 | Speers et al. | 24/81 BF |

*Primary Examiner*—L. J. Paperner

*Attorney, Agent, or Firm*—Shlesinger, Arkwright, Garvey & Dinsmore

[57] ABSTRACT

A retaining clip for attachment to a slip sheet used in the stacking and transportation of containers by forklift trucks or the like. A portion of the clip is attached to an edge of the slip sheet tab, and another portion thereof is inserted between, and grippingly engages, adjacent containers on a slip sheet so that the tab of the slip sheet is held up in position to be grasped by the forklift truck.

24 Claims, 16 Drawing Figures

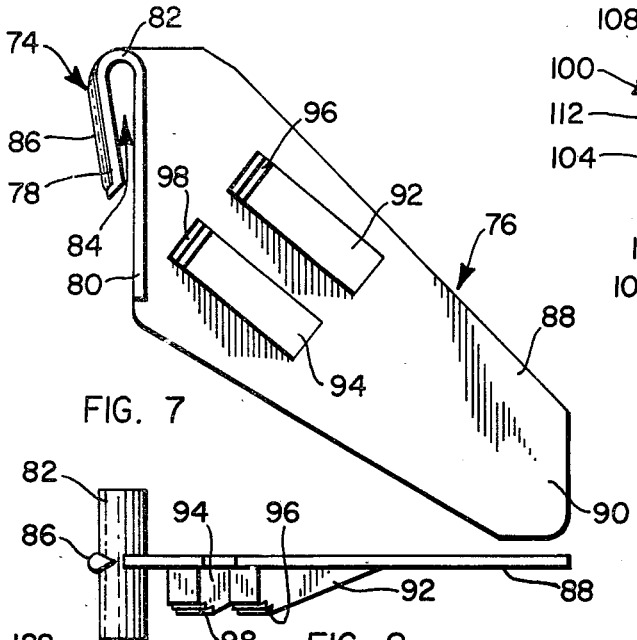
FIG. 7
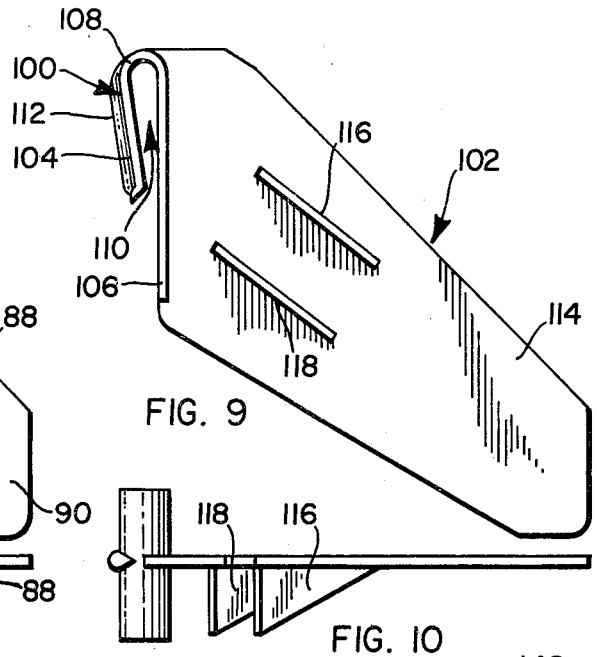
FIG. 9
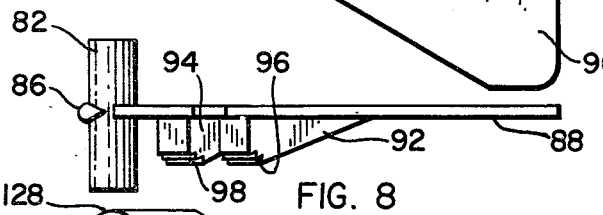
FIG. 8
FIG. 10
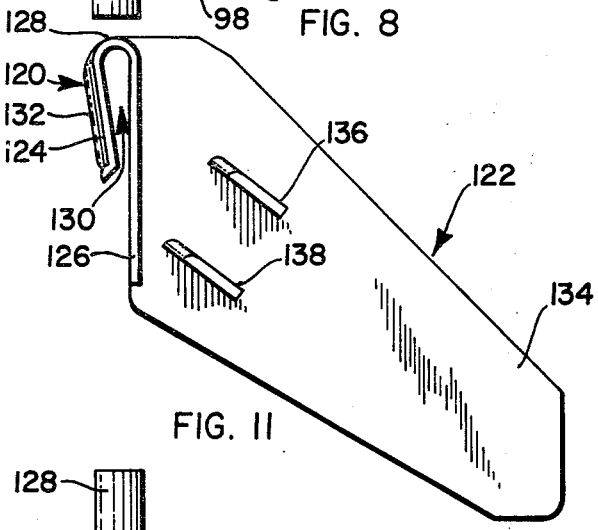
FIG. 11
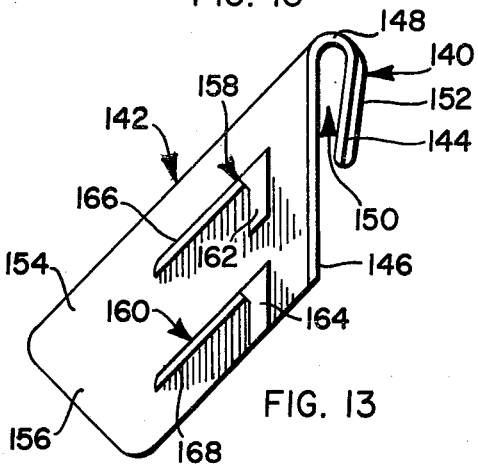
FIG. 13
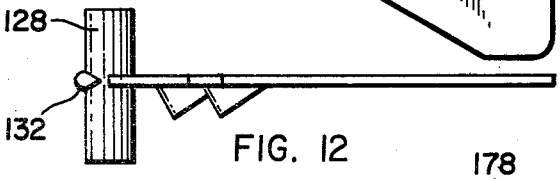
FIG. 12
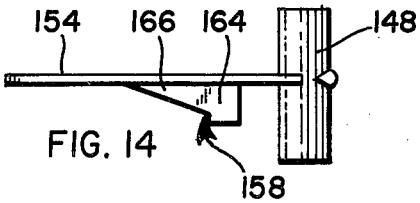
FIG. 14
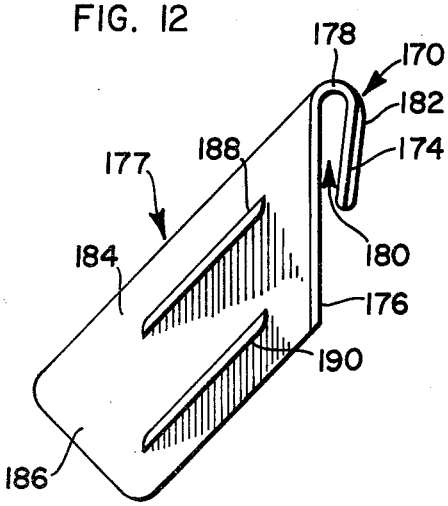
FIG. 15
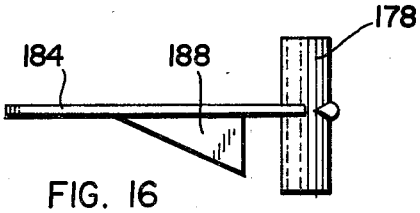
FIG. 16

SLIP SHEET RETAINING CLIP

BACKGROUND OF THE INVENTION

Slip Sheets are used in many instances instead of wooden pallets to stack and load containers onto trucks and railroad cars for transportation from one place to another. These slip sheets are made of pressed paper and plastic sheets and are scored adjacent their edges to form peripheral tabs. These tabs are bent upwardly with respect to the main body portion of the slip sheet so that specially equipped forklifts or like equipment can grip the tabs and pull a sheet loaded with containers onto the fork for loading onto trucks and railroad cars.

However, if the tab is not positioned at a substantially right angle to the main body of the slip sheet, then the tab will lie in the path of the next stack of containers when it is slid into place, with the result that the tab is destroyed or rendered useless for gripping by the forklift truck.

SUMMARY OF THE INVENTION

The present invention is a retaining clip which is readily attachable to the tab of a slip sheet and engageable with the containers supported on the main body portion of the slip sheet for holding the tab of the slip sheet at substantially a right angle to the main body portion of the slip sheet for engagement by a forklift truck.

The retaining clip includes a first part engageable with an edge of the tab and a second part insertable between adjacent containers stacked on the slip sheet, the second part including retaining means which frictionally engage the containers and present accidental disengagement of the second part therefrom.

The retaining clip further includes wedge means which may be driven into the interstice between adjacent containers by foot pressure or the like without the need of special tools, in a minimum of time and with little effort.

The retaining clip furthermore is of simple, economic construction, and enables the proper disposition of the tabs of the slip sheet for ready engagement with forklift equipment in order to effect the efficient and expeditious transfer of containers from storage space to transportation equipment and vice versa.

DESCRIPTION OF FIGURES OF THE DRAWING

FIG. 7 is a side elevational view of another modified form of the present invention;

FIG. 8 is a top plan view of the form of invention illustrated in FIG. 7;

FIG. 9 is a side elevational view of still another modified form of the present invention;

FIG. 10 is a top plan view of the form of invention illustrated in FIG. 9;

FIG. 11 is a side elevational view of a further modified form of the present invention;

FIG. 12 is a top plan view of the form of invention illustrated in FIG. 11;

FIG. 13 is a side elevational view of still another modified form of the present invention;

FIG. 14 is a top plan view of the form of invention illustrated in FIG. 13;

FIG. 15 is a side elevational view of a further modified form of the present invention, and FIG. 16 is a top plan view of the form of invention illustrated in FIG. 15.

DESCRIPTION OF FORM OF INVENTION ILLUSTRATED IN FIGS. 1 TO 4

Figure 1:
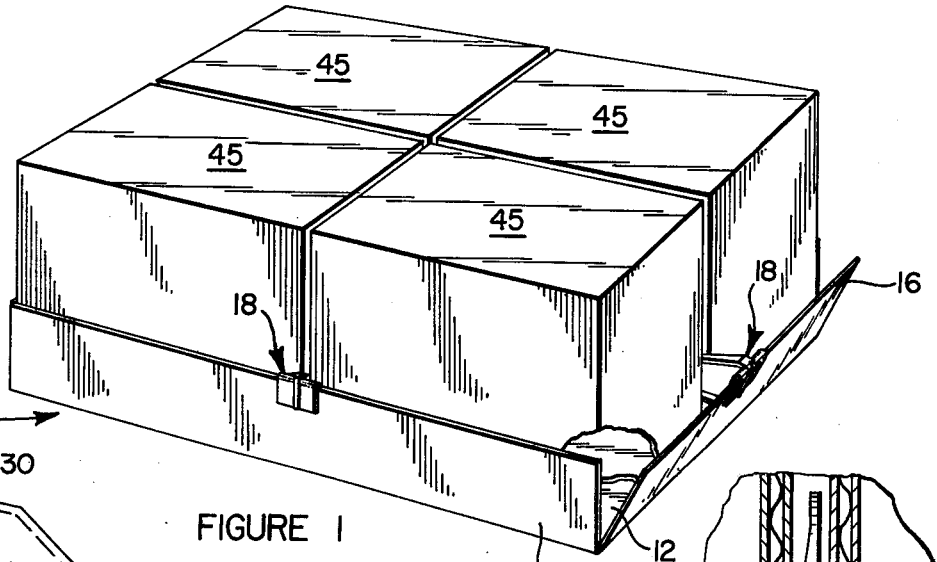
FIG. 1 is a perspective view of the slip sheet retaining clip of the present invention, illustrating its application.

In FIG. 1, there is illustrated a slip sheet generally designated 10 made of pressed paper and plastic sheets, which slip sheet includes a main body portion 12 of generally rectangular shape, the peripheral edges of which are scored and bent to provide side tabs 14 and end tabs 16. The slip sheet retaining clip of the present invention is generally designated 18.

The present retaining clip is preferably of molded plastic construction, such as polypropylene, and includes a clip part 20 and a retaining part 22.

Clip part 20 is of generally inverted U-shape configuration and includes a short leg 24 which is in spaced parallel relation to, and engaged with a long leg 26 by a connecting portion 28, thereby leaving a space 30 therebetween for the reception of the edge of a tab 14 or 16. Short leg 24 is preferably approximately ½ inch shorter than long leg 26 in order to facilitate engagement with the slip sheet tab. A reinforcing rib 25 extends longitudinally through the central portion of short leg 24.

Both legs are preferably approximately one inch in width and retaining part 22 extends outwardly and downwardly from the central portion of the outer face of long leg 26.

Retaining part 22 includes a flat body portion 32, the width of which at one end is substantially coextensive with long leg 26, but the longitudinal edges thereof taper inwardly towards each other and are joined at the far end by a short arcuate portion 34. Flat body portion 32 extends angularly in a downward direction with respect to clip part 20.

Figure 4:
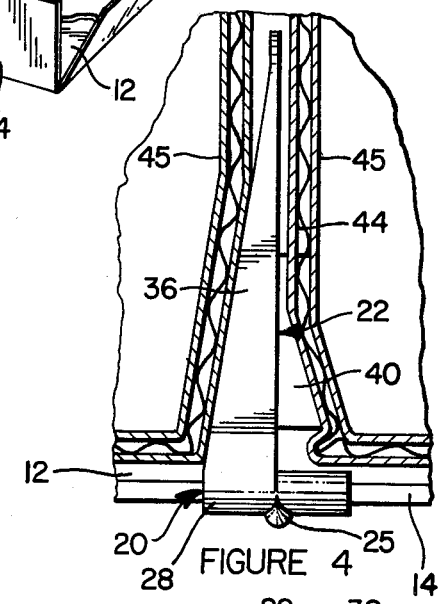
FIG. 4 is an enlarged transverse sectional view of the retaining clip of the present invention, illustrating its engagement with the slip sheet and the containers.
Figure 3:
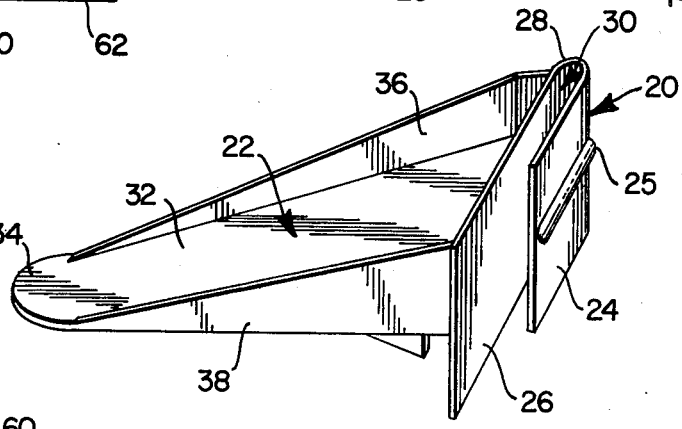
FIG. 3 is a perspective view of the present invention.

As shown to advantage in FIGS. 3 and 4, one face of flat body portion 32 is provided with wedge-shaped runners 36 and 38 extending longitudinally of the body portion along the upper and lower edges thereof. These runners are of substantially the same length and taper and, at their widest point adjacent long leg 26, and are approximately ½ inch in width, extending from the central portion of leg 26 to an edge thereof. As will be noted from FIG. 3, these runners taper gradually downward to a point proximate short arcuate portion 34 of flat body portion 32.

Figure 2:
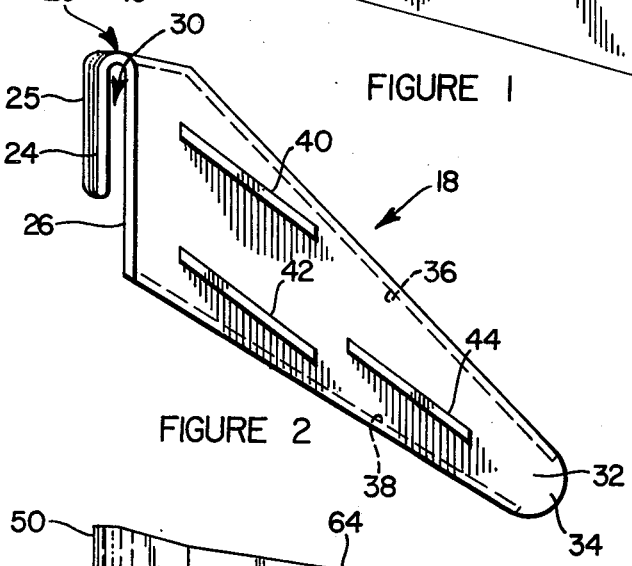
FIG. 2 is a side elevational view of the retaining clip of the present invention per se.

It is further within the contemplation of the present invention to provide flat body portion 32 with a plurality of container-impinging members comprising like, tapered prongs 40, 42 and 44 of wedge-shape which extend outwardly from the face of flat body portion 32 opposite runners 36 and 38. As will be noted from FIGS. 2 and 4, prongs 40, 42 and 44 are tapered inwardly from the clip portion end of the flat body portion so that upon insertion of the retaining clip between containers, the wide end of the prongs impinge against the sides of the containers as shown in FIG. 4, to prevent casual displacement of the clip.

In use of the retaining clip of the present invention, containers 45, which are preferably corrugated cardboard boxes, are placed on slip sheet 10 and retaining clips 18 are positioned by engaging clip part 20 with tabs 14 or 16 of the slip sheet, the retaining clips being initially engaged as shown by the manner of engagement of clip 18 with end tab 16 of FIG. 1.

In order to properly position retaining part 22, short leg 24 may be struck with the foot or by a suitable tool to force body portion 32 into the space between adjacent containers. As shown to advantage in FIG. 4, runners 36 and 38 of the clip act as wedges which effect a bending of the cardboard walls of the adjacent containers and cause prongs 40, 42 and 44 to bite into the corrugated cardboard walls, and prevent accidental removement of the slip sheet clip therefrom.

When the retaining clip has been positioned in the manner shown in FIG. 4, tabs 14 and 16 are thereby lifted to an upright position in substantially right angular relationship to main body portion 12, thereby permitting the tabs to be readily grasped by the forklift truck for removal. The tabs are also lifted out of the path of movement of a second stack of boxes which may be placed adjacent thereto, thereby preventing damage to the tabs which would otherwise prevent engagement by the forklift equipment.

DESCRIPTION OF FORM OF INVENTION ILLUSTRATED IN FIGS. 5 AND 6

Figure 5:
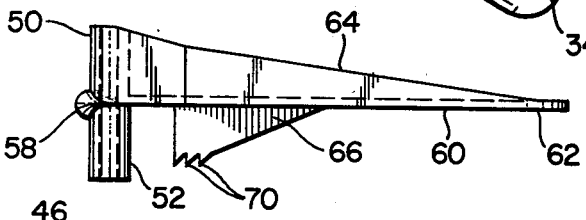
FIG. 5 is a top plan view of a modified form of the present invention.
Figure 6:
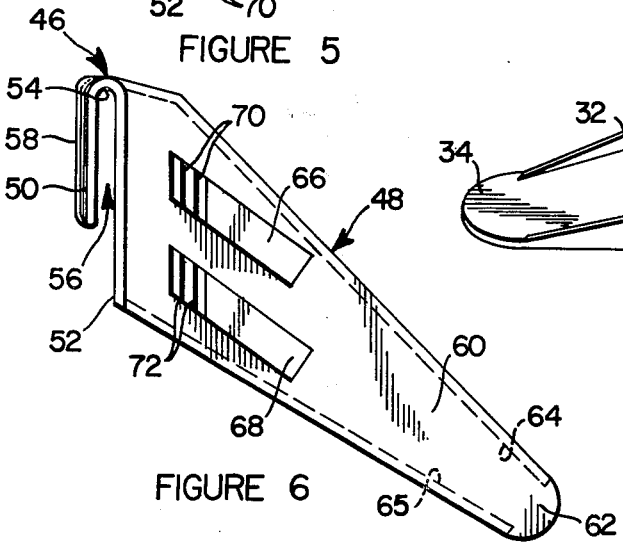
FIG. 6 is a side elevational view of the form of invention illustrated in FIG. 5.

In FIGS. 5 and 6, there is illustrated a modified form of the retaining clip of the present invention including a clip part 46 and a retaining part 48. Clip part 46 is of generally inverted U-shape configuration and includes a short leg 50 in spaced relation to a long leg 52 and engaged therewith by a connecting portion 54. This leaves a space 56 between legs 50 and 52. The outer face of leg 50 is provided with a central reinforcing rib 58.

Retaining part 48 includes a flat body portion 60 disposed at an angle to leg 52, which includes longitudinal wall portions tapered toward each other and which are joined by a short arcuate portion 62. Just as in the form of invention illustrated in FIGS. 1 to 4, there are provided wedge-shaped runners 64 and 65 extending inwardly from the peripheral edges of one face of flat body portion 60. In accordance with this form of invention, there is provided a pair of wedge-shaped blocks 66 and 68 extending outwardly from the opposite face of flat body portion 60 which blocks are also tapered, but wherein, at the widest part of the blocks, there are provided a plurality of teeth designated 70 and 72, respectively, which serve to increase the gripping engagement of the blocks with the containers located on the slip sheet. In this form of the invention also, blocks 66 and 68 are thicker than prongs 40, 42 and 44 in order to afford greater surface area contact with the containers which they engage.

DESCRIPTION OF FORM OF INVENTION ILLUSTRATED IN FIGS. 7 AND 8

In FIGS. 7 and 8 there is illustrated another modified form of the present invention including a clip part 74 and a retaining part 76. Clip part 74 is of inverted U-shape and includes a short leg 78 in spaced relation to a long leg 80 and joined thereto by a connecting portion 82. A space 84 is provided between legs 78 and 80 for receiving the edge of the slip sheet and the outer face of leg 78 is provided with a central reinforcing rib 86.

Retaining part 76 includes a flat body portion 88 disposed at an angle to leg 80, the width of the body portion adjacent leg 80 being substantially coextensive with the length thereof. The longitudinal edges of flat body portion 88 gradually taper towards each other and are joined by a generally arcuate portion 90. In this form of the invention there are no runners extending outwardly from one face of the flat body portion. However, there are provided a pair of wedge shaped blocks 92 and 94 extending outwardly from a face of flat body portion 88, the longitudinal axes of which block extend at approximately the same angle to leg 80 as flat body portion 88. The edge of the widest part of blocks 92 and 94 are provided with a plurality of teeth designated 96 and 98, respectively, which serve to increase the gripping engagement of the blocks with the containers positioned on the slip sheet.

This form of the invention is similar to that disclosed in FIGS. 5 and 6, with the exception that this form of the invention enables the clip to be used for insertion between containers where there is less space between the containers and not much give to the boxes.

DESCRIPTION OF FORM OF INVENTION ILLUSTRATED IN FIGS. 9 AND 10

In FIGS. 9 and 10 there is illustrated another modified form of the present invention including a clip part 100 and a retaining part 102. Clip part 100 is of inverted U-shape and includes a short leg 104 and a long leg 106 joined by a connecting portion 108. This provides a space 110 between the legs for receiving the edge of the slip sheet. The outer face of leg 104 is provided with a central reinforcing rib 112.

Retaining part 102 includes a flat body portion 114 which is similar in shape to that disclosed in the form of invention illustrated in FIGS. 7 and 8 and disposed at approximately the same angle with respect to long leg 106. A pair of parallel, spaced prongs of wedge shape are indicated at 116 and 118, the longitudinal axis of each of which prongs is substantially parallel to the longitudinal axis of flat body portion 114. It will be noted from a consideration of FIG. 10 that prongs 116 and 118 are similar to prongs 40, 42 and 44 of the retaining clip of FIGS. 1 to 4, but wherein there are no wedge-shaped runners, in order that this retaining clip may be employed with closely positioned containers.

DESCRIPTION OF FORM OF INVENTION ILLUSTRATED IN FIGS. 11 AND 12

In FIGS. 11 and 12, there is illustrated still another modified form of the present retaining clip which includes a clip part 120 and a retaining part 122. Clip part 120 is of generally inverted U-shape and includes a short leg 24 and a long leg 26, which are joined by a connecting portion 128. A space 130 is thereby provided between legs 124 and 126 for receiving an edge of side tab 14 or end tab 16. The outer face of leg 124 is provided with a central reinforcing rib 132.

Retaining part 122 includes a flat body portion 134 which is similar in shape to the forms of invention illustrated in FIGS. 7 and 8 and FIGS. 9 and 10, and is disposed at approximately the same angle with respect to long leg 106. A pair of spaced, parallel pegs of wedge-shape are indicated at 136 and 138, the longitudinal axes of each of which is substantially parallel to the longitudinal axis of flat body portion 134.

It will be noted from this form of invention that pegs 136 and 138 are considerably smaller than wedge-shape prongs used in other forms of the invention, and this permits use of this form of the retaining clip in situations where there is very little space between adjacent containers.

DESCRIPTION OF FORM OF INVENTION ILLUSTRATED IN FIGS. 13 AND 14

In FIGS. 13 and 14, there is illustrated a still further modification of the retaining clip of the present invention including a clip part 140 and a retaining part 142. Clip part 140 is of inverted U-shape and includes a short leg 144 and a long leg 146 which are joined by a connecting portion 148. A space 150 is thereby provided between legs 144 and 146 for receiving an edge of slip sheet tab 14 or 16. The outer face of leg 144 is provided with a central reinforcing rib 152.

Retaining part 142 includes a relatively small flat body portion 154 disposed at an angle to long leg 146 of clip part 140. The longitudinal edges of flat body portion 154 are in substantial parallel relation and terminate in a blunt end portion 156.

In accordance with this form of the invention, instead of providing prongs, blocks or pegs of rectilinear configuration, there are provided a pair of spaced angular wedge-shaped prongs 158 and 160. Prongs 158 and 160 include vertical teeth members 162 and 164 which are substantially parallel to long leg 146 and tapering wedge-shaped members 166 and 168 extending towards blunt portion 156 of flat body portion 154. Prongs 158 and 160 thereby effect surface contact with a substantial area of the container engaged by the retaining clip.

DESCRIPTION OF FORM OF INVENTION ILLUSTRATED IN FIGS. 15 AND 16

In FIGS. 15 and 16 there is illustrated another form of the retaining clip of the present invention including a clip part 170 and a retaining part 172. Clip part 170 is of inverted U-shape and includes a short leg 174 and a long leg 176 which are joined by a connecting portion 178. A space 180 is thereby provided between legs 174 and 176 for receiving an edge of slip sheet tab 14 or 16. The outer face of leg 174 is provided with a central reinforcing rib 182.

Retaining part 172 includes a flat body portion 184 which is similar in shape and size to the flat body portion of the form of invention illustrated in FIGS. 13 and 14, and is disposed at approximately the same angle with respect to long leg 176. The longitudinal edges of body portion 184 are substantially parallel and the body portion terminates in a blunt end 186.

A pair of spaced, parallel prongs of wedge-shape are indicated at 188 and 190, the longitudinal axis of each of which prongs is substantially parallel to the longitudinal axis of flat body portion 184.

The various retaining clips of the present invention provide simple, economic means which may be readily attached to the tabs of slip sheets and engaged with a variety of containers positioned on the slip sheet to hold the tabs thereof in the proper, upstanding position to prevent damage to the tabs of the slip sheet and also to facilitate engagement with the forklift equipment. These clips are readily and quickly installed without the use of any special tools, and may be carried out by unskilled labor.

While there has been herein shown and described the presently preferred forms of this invention, it is to be understood that such has been done for purposes of illustration only, and that various changes may be made therein within the scope of the appended claims.

What is claimed is:

1. In combination with a slip sheet having a main body portion on which a plurality of containers are placed, the lateral edges of which main body portion are scored to provide tabs along the peripheral edges thereof, a slip sheet retaining clip comprising:

(a) a first part engageable with a peripheral edge of said slip sheet tab, and (b) a second part including a substantially flat body portion extending outwardly from, and at an angle to, the plane of said first part and insertable between adjacent containers (c) said second part including retaining members extending outwardly from the flat body portion of said second part into frictional engagement with a container to hold an edge of the slip sheet tab in fixed position at approximately a right angle to the main body portion of the slip sheet.

2. The slip sheet retaining clip of claim 1, wherein:

(a) said first part is of generally inverted U-shape configuration for engagement over the edge of the tab.

3. The slip sheet retaining clip of claim 1, wherein:

(a) said retaining members are of wedge-shape.

4. The slip sheet retaining clip of claim 3, wherein:

(a) said retaining members comprise a plurality of wedge-shaped prongs.

5. The slip sheet retaining clip of claim 3, wherein:

(a) said retaining members comprise a plurality of wedge-shaped blocks.

6. The slip sheet retaining clip of claim 3, with the addition of:

(a) teeth along the edges of said wedge-shaped blocks for grippingly engaging a container.

7. The slip sheet retaining clip of claim 3, wherein:

(a) said retaining members comprise a plurality of wedge-shaped pegs.

8. The slip sheet retaining clip of claim 3, wherein:

(a) said retaining members are of angular shape.

9. The slip sheet retaining clip of claim 1, with the addition of:

(a) a tapered runner extending outwardly and longitudinally of the opposite face of said flat body portion.

10. The slip sheet retaining clip of claim 9, with the addition of:

(a) a second tapered runner extending outwardly and longitudinally of the opposite face of said flat body portion (b) said tapered runners being proximate the longitudinal edges of said flat body portion.

11. In combination with a slip sheet having a main body portion on which a plurality of containers are placed, the lateral edges of which main body portion are scored to provide tabs along the peripheral edges thereof, a slip sheet retaining clip comprising:

(a) a clip part for receiving an edge of a slip sheet tab, and (b) a retaining part engaged with said clip part (c) said retaining part including a flat body portion extending outwardly at an angle to the plane of said clip part for insertion into the space between adjacent containers (d) said retaining part further including impinging members extending outwardly from one face of said flat body portion into frictional engagement with a container wall.

12. The slip sheet retaining clip of claim 11, wherein:
(a) said clip part is of generally inverted U-shape configuration.

13. The slip sheet retaining clip of claim 11, wherein:
(a) said impinging members are of wedge-shape.

14. The slip sheet retaining clip of claim 13, wherein:
(a) said impinging members comprise tapered prongs.

15. The slip sheet retaining clip of claim 13, wherein:
(a) said impinging members comprise tapered blocks.

16. The slip sheet retaining clip of claim 15, with the addition of:
(a) teeth along the edges of said wedge-shaped blocks for grippingly engaging a container.

17. The slip sheet retaining clip of claim 13, wherein:
(a) said retaining members comprise a plurality of wedge-shaped pegs.

18. The slip sheet retaining clip of claim 13, wherein:
(a) said retaining members are of angular shape.

19. The slip sheet retaining clip of claim 11, with the addition of:
(a) a tapered runner extending outwardly and longitudinally of the opposite face of said flat body portion.

20. The slip sheet retaining clip of claim 19, with the addition of:
(a) a second tapered runner extending outwardly and longitudinally of the opposite face of said flat body portion
(b) said tapered runners being proximate the longitudinal edges of said flat body portion.

21. In combination with a slip sheet having a main body portion on which a plurality of containers are placed, the lateral edges of which main body portion are scored to provide tabs along the peripheral edges thereof, a slip sheet retaining clip comprising:
(a) a first part engageable with a peripheral edge of said slip sheet tab
(b) said first part being of generally inverted U-shape configuration for engagement over the edge of the tab
(c) a second part extending from said first part and insertable between adjacent containers
(d) said second part including retaining means engageable with the adjacent containers, whereby said tab is held up at approximately a right angle to the main body portion of the slip sheet.

22. In combination with a slip sheet having a main body portion on which a plurality of containers are placed, the lateral edges of which main body portion are scored to provide tabs along the peripheral edges thereof, a slip sheet retaining clip comprising:
(a) a clip part for receiving an edge of a slip sheet tab
(b) said clip part being of generally inverted U-shape configuration
(c) a retaining part engaged with said clip part
(d) said retaining part including a flat body portion extending outwardly from said clip part for insertion into the space between adjacent containers
(e) said retaining part further including impinging members extending outwardly from one face of said flat portion into frictional engagement with a container wall.

23. In combination with a slip sheet having a main body portion on which a plurality of containers are placed, the lateral edges of which main body portion are scored to provide tabs along the peripheral edges thereof, a slip sheet retaining clip comprising:
(a) a clip part for receiving an edge of a slip sheet tab, and
(b) a retaining part engaged with said clip part
(c) said retaining part including a flat body portion extending outwardly from said clip part for insertion into the space between adjacent containers
(d) said retaining part further including impinging members extending outwardly from one face of said flat body portion into frictional engagement with a container wall
(e) the opposite face of said flat body portion being provided with a tapered runner extending outwardly and longitudinally thereof.

24. The slip sheet retaining clip of claim 23, with the addition of:
(a) a second tapered runner extending outwardly and longitudinally of said opposite face of said flat body portion
(b) said tapered runners being proximate the longitudinal edges of said flat body portion.

* * * * *